US007695357B2

(12) United States Patent
Fleury et al.

(10) Patent No.: US 7,695,357 B2
(45) Date of Patent: Apr. 13, 2010

(54) ENTERTAINMENT SYSTEM AND METHOD OF PLAYING A WORD GAME

(76) Inventors: Patricia L. Fleury, 6062 Fireside Dr., Rockford, IL (US) 61114; Martha K. Carter, 3625 S. Cottonwood Rd., New Berlin, WI (US) 53151

( * ) Notice: Subject to any disclaimer, the term of this patent is extended or adjusted under 35 U.S.C. 154(b) by 585 days.

(21) Appl. No.: 11/566,752

(22) Filed: Dec. 5, 2006

(65) Prior Publication Data

US 2008/0132304 A1 Jun. 5, 2008

(51) Int. Cl.
*A63F 9/24* (2006.01)

(52) U.S. Cl. ..... 463/11; 463/1; 273/272; 273/240; 273/236; 434/171; 434/172

(58) Field of Classification Search ..... 463/1, 463/11; 273/272, 240, 236; 434/171, 172
See application file for complete search history.

(56) References Cited

U.S. PATENT DOCUMENTS

| | | | | | |
|---|---|---|---|---|---|
| 2,752,158 | A * | 6/1956 | Brunot et al. | ..... | 273/272 |
| 3,655,195 | A | 4/1972 | Bean et al. | | |
| 3,840,236 | A * | 10/1974 | Beskrone | ..... | 273/272 |
| 4,190,255 | A * | 2/1980 | Hughes | ..... | 273/272 |
| 4,207,087 | A * | 6/1980 | Morrison et al. | ..... | 463/9 |
| 4,591,161 | A * | 5/1986 | Vanderhoof | ..... | 273/272 |
| 4,772,027 | A * | 9/1988 | Martel et al. | ..... | 273/237 |
| 4,773,651 | A * | 9/1988 | Papapavlou | ..... | 273/249 |
| 5,058,896 | A | 10/1991 | Bez | | |
| 5,746,430 | A | 5/1998 | Chester | | |
| 6,102,397 | A * | 8/2000 | Lee et al. | ..... | 273/238 |
| 6,109,609 | A | 8/2000 | Ekberg | | |
| 6,378,868 | B1 | 4/2002 | La Bossiere | | |
| 6,986,512 | B2 * | 1/2006 | Charpentier | ..... | 273/272 |
| 7,008,316 | B1 * | 3/2006 | Pugh | ..... | 463/10 |
| 7,118,110 | B2 * | 10/2006 | Kowalczyk | ..... | 273/272 |
| 2004/0171413 | A1 * | 9/2004 | Charpentier | ..... | 463/9 |
| 2005/0137004 | A1 * | 6/2005 | Wood et al. | ..... | 463/11 |
| 2006/0135265 | A1 * | 6/2006 | Hall et al. | ..... | 463/46 |

* cited by examiner

*Primary Examiner*—Dmitry Suhol
*Assistant Examiner*—Chase Leichliter
(74) *Attorney, Agent, or Firm*—Dale J. Ream

(57) ABSTRACT

An entertainment system includes a playing surface divided into discrete fields each having distinct indicia such as a color. The system includes a plurality of game pieces, such as letter tiles, each having an indicia corresponding to a respective field as well as having an alphanumeric or user-choice indicia. The entertainment system includes an input device for actuating a timer or processor. A display is included for displaying instructions, aesthetic elements, or even a sound emitter. A method of playing the entertainment system includes a plurality of players initially selecting a predetermined number of game pieces and then, in turn, arranging game pieces on playing surface fields having like color indicia to form words, selecting additional game pieces or taking other actions relative to game pieces, and rearranging game pieces to form other words. Electronic components are included to provide elements of chance, instructions, or aesthetic appeal.

14 Claims, 6 Drawing Sheets

ENTERTAINMENT SYSTEM AND METHOD OF PLAYING A WORD GAME

BACKGROUND OF THE INVENTION

The present invention relates to games and, more particularly to an entertainment system and method of playing the same.

Games have in the past and continue to be popular sources of entertainment amongst families and friends. The best games have an element of competition, strategy, and chance while enabling players who are skillful, clever, or observant to excel and win. In addition, popular games are often those that teach or enable player to improve their education or experience.

Various games are known in the art that require players to assemble letter tokens to construct words and provide point systems for such combinations. Other games utilize elements of chance to increase or decrease a player's collection of game pieces so as to regulate game play. Although assumably effective for their intended purpose, the existing game systems do not provide a multi-functional and multi-colored game board with associated letter tiles in which letters may not only be combined into words, but re-arranged into different words in order to use all of one's letter tiles and win the game.

Therefore, it would be desirable to have an entertainment system having multiple letter tiles that may be positioned to form words on game board areas having corresponding colors. Further, it would be desirable to have an entertainment system in which letters may be combined to form words and then be rearranged to form different words. In addition, it would be desirable to have an entertainment system having electronic means for randomizing the number of letter tiles a player is required to possess, it being understood that the object of the game is to eventually use all of one's tiles.

SUMMARY OF THE INVENTION

An entertainment system and method for playing the same according to the present invention includes a playing surface, a plurality of game pieces, an input device, a display, and a processor. The playing surface is divided into a plurality of discrete fields with each respective field having distinct indicia, such as a color, number, shape, symbol, or the like. Each respective game piece includes indicia corresponding to indicia of a respective field, each respective game piece displaying an alphabetic letter or user-choice indictor. The input device is operatively connected to the processor and timer and may be used to actuate these components. The display may include a visual display for displaying visual instructions or aesthetic portions and may include a sound emitter for providing audible instructions or other sounds. The processor is in data communication with the input device and display and includes programming for actuating the display to present an instruction randomly selected from a plurality of predetermined instructions upon actuation of the input device. Each respective game board field is sized to receive a plurality of game pieces positioned in a juxtaposed configuration.

In game play, each player is able to select a predetermined number of game pieces. Each game piece (e.g. letter tile) includes indicia (such as color) and may be situated on a rack at a position matching a same color of indicia. In turn, a player may press the input device to actuate a timer and then determines if he can place any game pieces upon the playing surface to form a word. As described above, game pieces must have indicia corresponding with indicia of a respective field and placed game pieces must spell a word. In subsequent turns, players may re-arrange tiles on the board to form different words. If at the start of a players turn a play cannot be made, a player may press the input device such that the processor and display cooperate to present an instruction, such as to draw additional letter tiles.

Therefore, a general object of this invention is to provide an entertainment system for the entertainment of multiple players.

Another object of this invention is to provide an entertainment system, as aforesaid, which includes a playing surface divided into discrete fields, each of which includes a color corresponding with colored game pieces such as alphabetic letter tiles that can only be played on a corresponding field.

Still another object of this invention is to provide an entertainment system, as aforesaid, in which a user attempts to arrange game pieces into words or to rearrange existing word combinations to form different words.

Yet another object of this invention is to provide an entertainment system, as aforesaid, having electronic components that determine whether a player must choose additional game pieces to play or take other actions concerning game pieces.

A further object of this invention is to provide an entertainment system, as aforesaid, that includes magnetic structures for stabilizing game play.

A still further object of this invention is to provide an entertainment system, as aforesaid, that is easy and cost-effective to manufacture.

Another object of this invention is to provide an entertainment system, as aforesaid, that provides an educational benefit by challenging a player's vocabulary and spelling skills.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
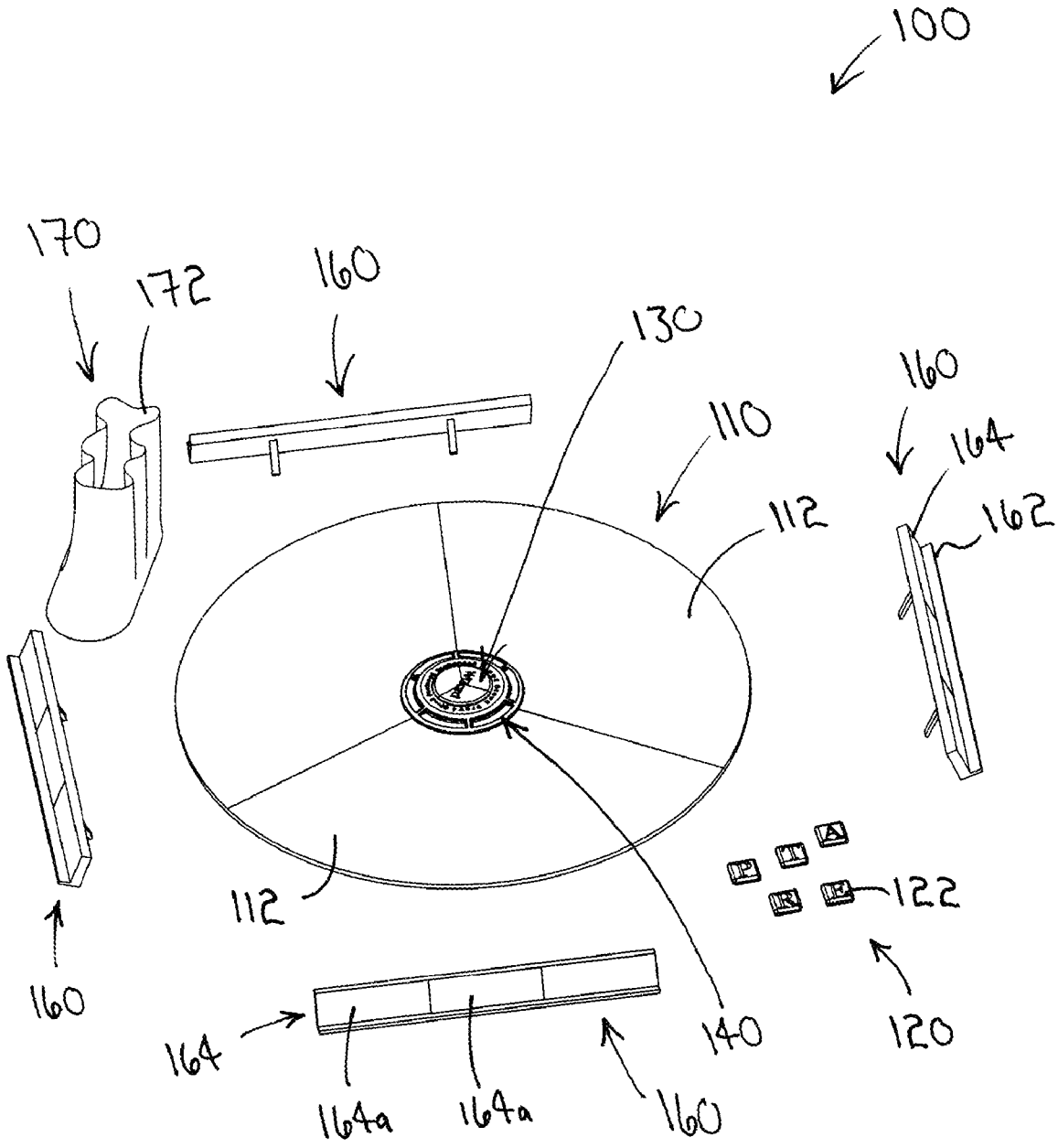
FIG. 1 is a perspective view of an entertainment system according to a preferred embodiment of the present invention.

An entertainment system 100 and a method 200 of playing a word game according to the present invention will now be described in detail with reference to FIGS. 1 through 6 of the accompanying drawings. More particularly, an entertainment system 100 according to the current invention includes a playing surface 110, a plurality of game pieces 120, an input device 130, a display 140, and a processor 150.

Figure 2:
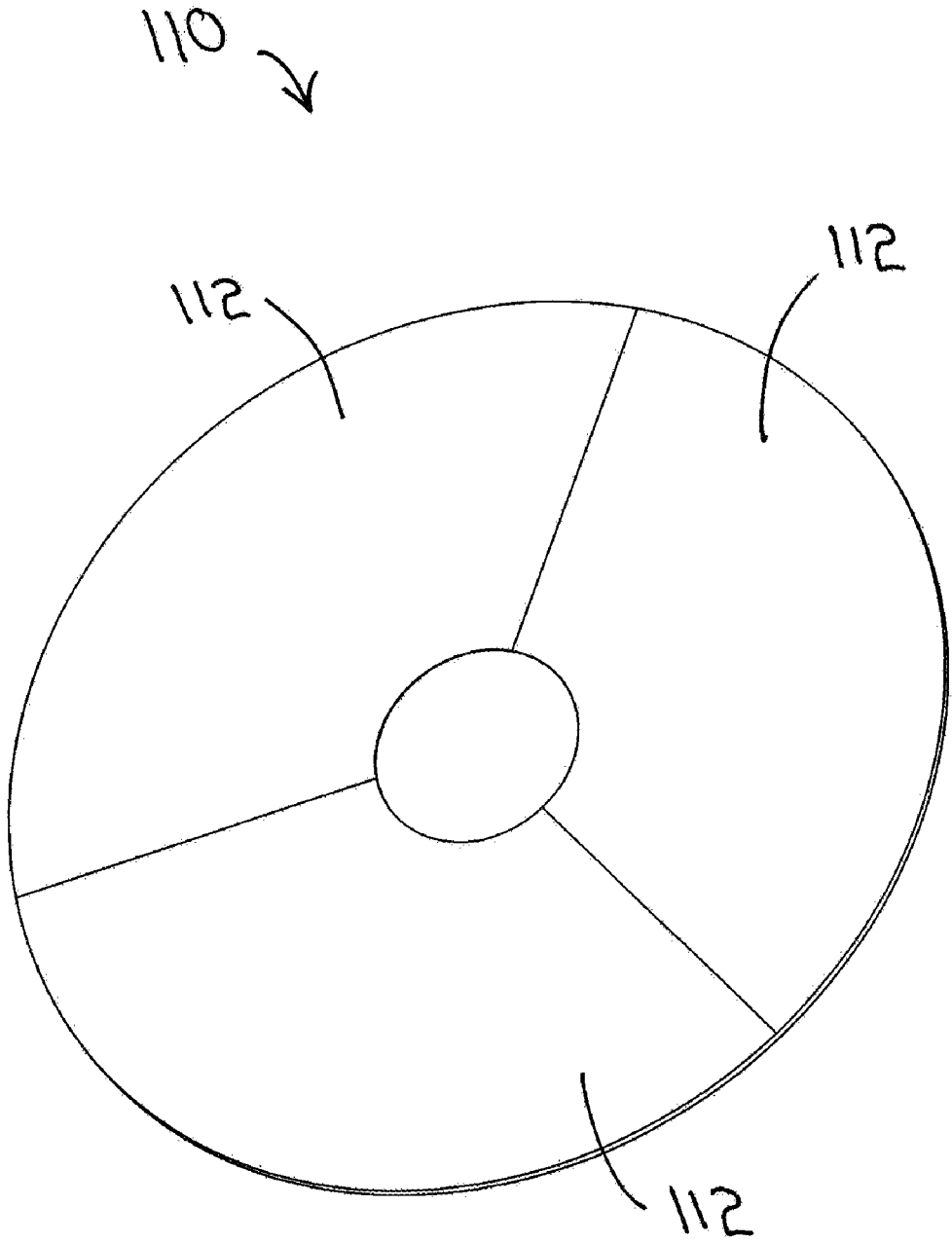
FIG. 2 is a perspective view of a playing surface as in FIG. 1 removed from the rest of the system.

As shown in FIGS. 1 and 2, the playing surface 110 is divided into a plurality of discrete fields 112, and each field 112 has distinct indicia such as color, number, shape, or symbol. While three fields 112 are shown, two or more fields 112 may be included. In one embodiment, the playing surface 110 is metallic and the game pieces 120 are magnetic. In another embodiment, the playing surface 110 is magnetic and the game pieces 120 are metallic; though not shown, each game piece 120 may have a recessed metallic central area and a non-metallic outer area, allowing the game pieces 120 to be both magnetically coupled to the playing surface 110 and easily removed from the playing surface 110 when desired. The playing surface 110 may be circular as shown in FIGS. 1 and 2 and have an imaginary center point, or the playing surface 110 may alternately be shaped in another appropriate configuration. However, each respective field 112 must be sized to receive a plurality of the game pieces 120 positioned in a juxtaposed configuration.

Figure 4:
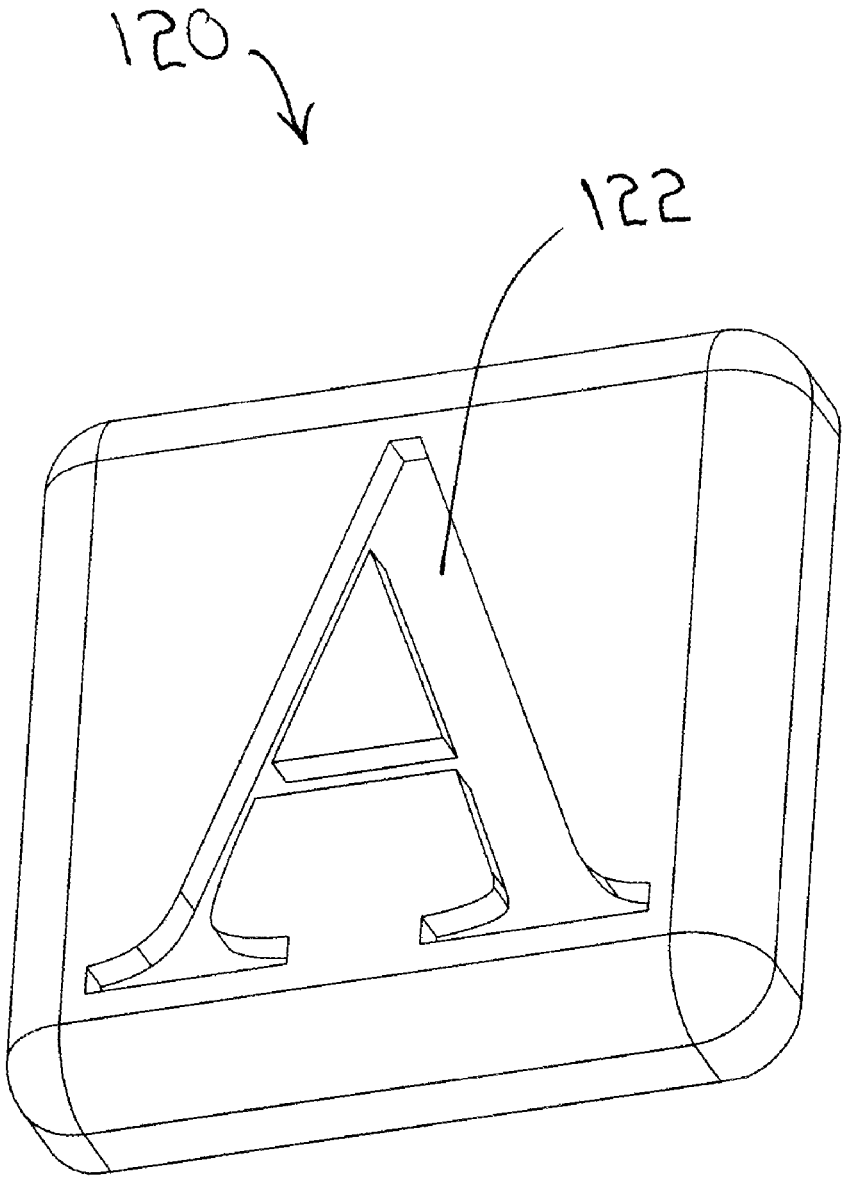
FIG. 4 is a perspective view of a game piece as in FIG. 1.

Each game piece 120 has indicia corresponding to indicia of a respective field 112, such as color, number, shape, or symbol. As shown in FIGS. 1 and 4, each piece 120 displays an alphabetic letter 122 or a user-choice indicator (not shown) such as a blank space, a shape, a symbol, or a trademark. The game pieces 120 may also be referred to herein as letter tiles.

Figure 3:
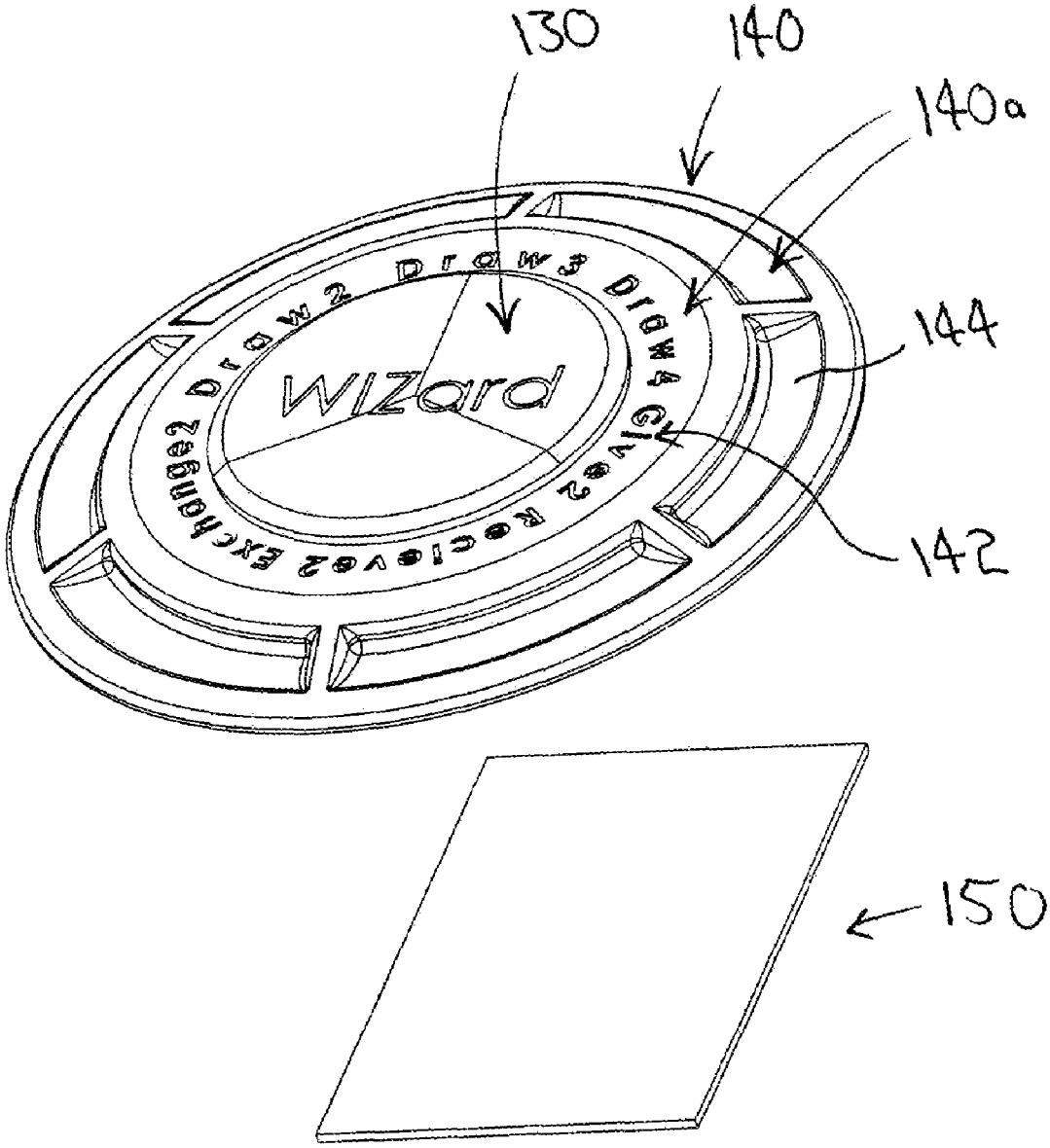
FIG. 3 is a perspective view of a display and processor as in FIG. 1 removed from the remainder of the system.

As shown in FIG. 1, the input device 130 may be at the imaginary center point of the playing surface 110. The display 140 may be an audible display 140*b* (FIG. 5) and/or a visual display 140*a* (FIGS. 3 and 5), and as shown in FIG. 3, a visual display 140*a* may circle the input device 130. The visual display 140*a* shown in FIG. 3 includes a plurality of selectively illuminating predetermined instructions 142 and a plurality of selectively illuminating aesthetic portions 144. In operative cooperation with the processor 150, the aesthetic portions 144 may be energized to blink, sustain, or be illuminated in a chase sequence.

The processor 150 may be in data communication with the input device 130 and the display 140 (FIG. 5), and the processor 150 may include various programming. For example, the processor 150 may include programming for actuating the display 140 to present an instruction 142 randomly selected from a plurality of predetermined instructions 142 upon actuation of the input device 130. Further, the processor 150 may include programming for selectively illuminating the aesthetic portions 144 of the visual display 140*a*; and/or programming for selectively actuating the audible display 140*b*. The processor 150 may additionally or alternately include a timer 152 for determining a predetermined amount of elapsed time and programming for actuating the display 140 upon the timer 152 determining the predetermined amount of elapsed time.

It is understood that expiration of the timer 152 may cause, in cooperation with the processor 150 and display 140, the visual display 140*a* and/or audible display 140*b*, to be energized, or to be interrupted if already energized. For example, the processor 150 may include programming to energize the aesthetic portions 144 of the visual display 140*a* to blink or chase while the timer 152 is counting down and then to stop when the timer has expired. In that case, the processor 150 may also include programming to energize the sound emitter 140*b* upon timer expiration to further draw attention to that condition. Of course, the processor 150 may include other programming for operating the display 140 in association with other events.

A plurality of racks 160 and/or a container 170 (e.g. a bag) may be included as shown in FIG. 1. Each rack 160 may have a lip 162 and a back region 164 to collectively hold a plurality of the game pieces 120 in an upright configuration. Each back region 164 may include a plurality of distinct sections 164*a*, and each section 164*a* may have indicia that corresponds to the indicia of a respective field 112 (e.g. corresponding colors). The container 170 may be configured for housing at least a portion of the plurality of game pieces 120, and the container 170 may have an opening 172 for inserting and removing the game pieces 120.

Figure 6:
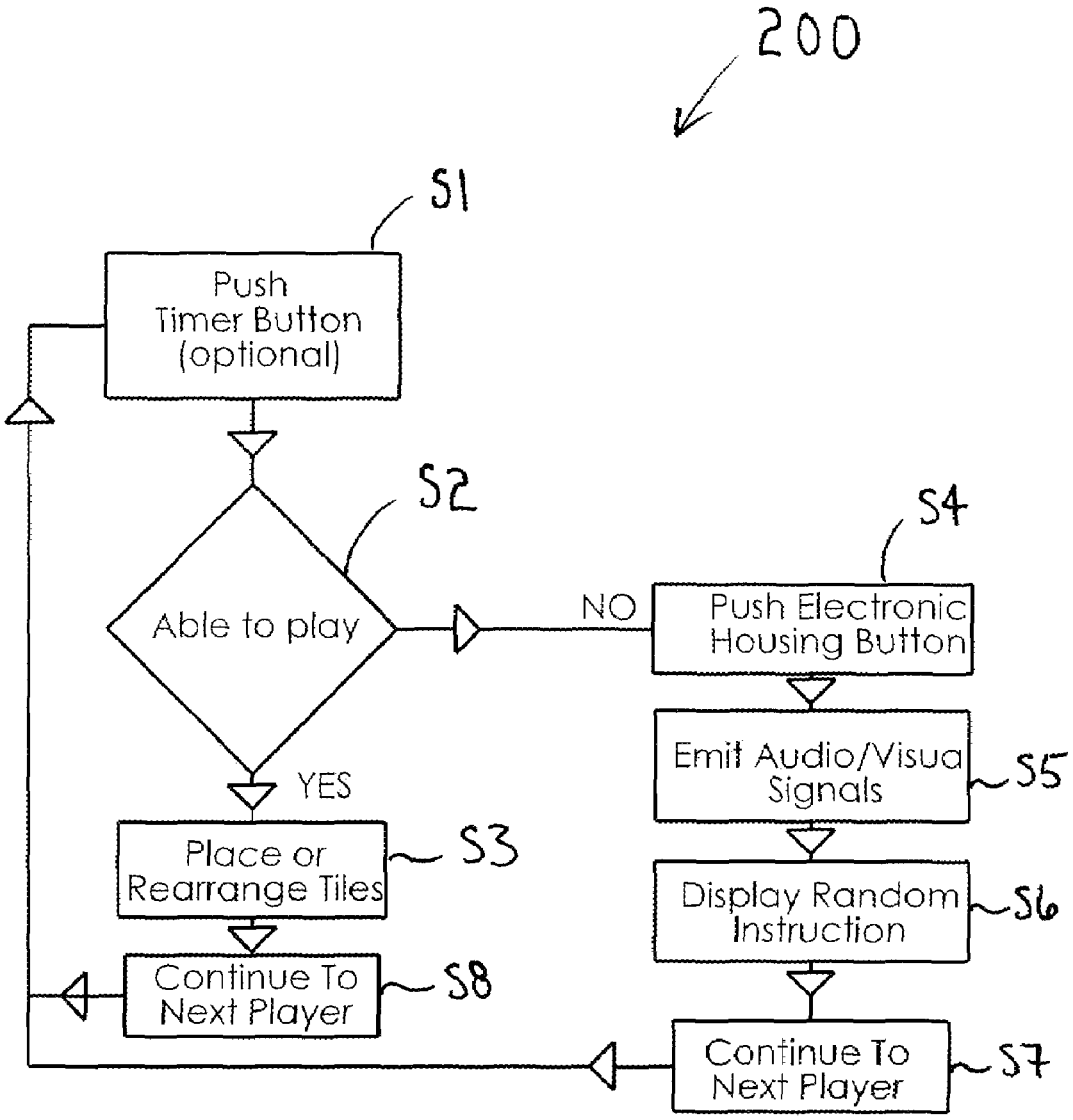
FIG. 6 is a flowchart illustrating the logic performed by the processor of FIG. 5.
Figure 1:
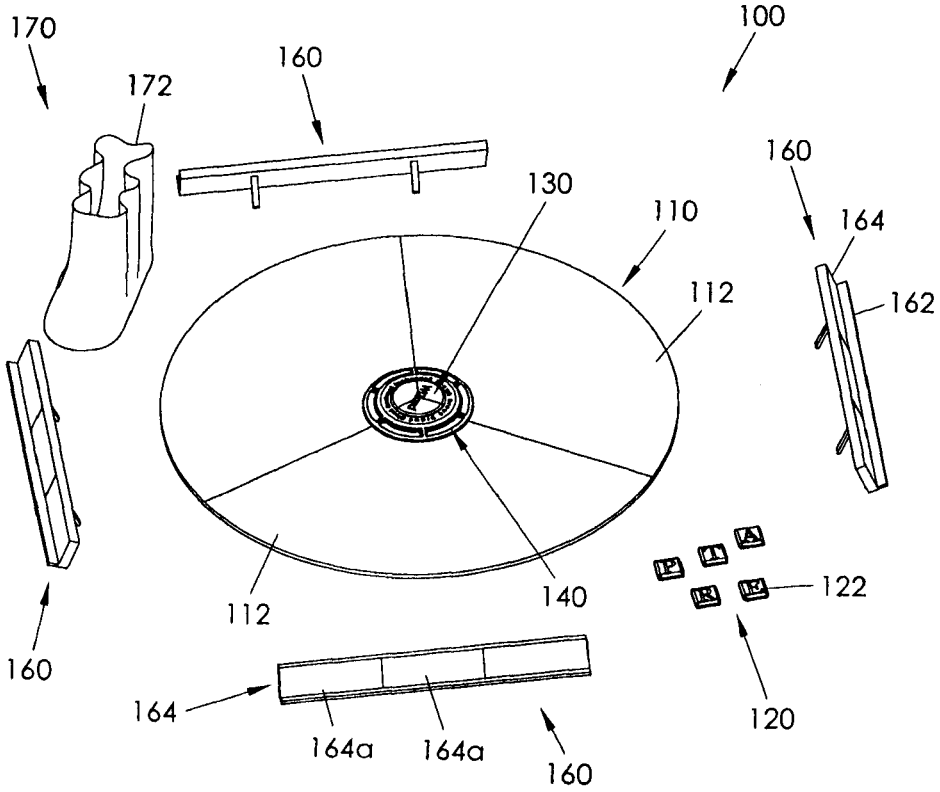
Figure 2:
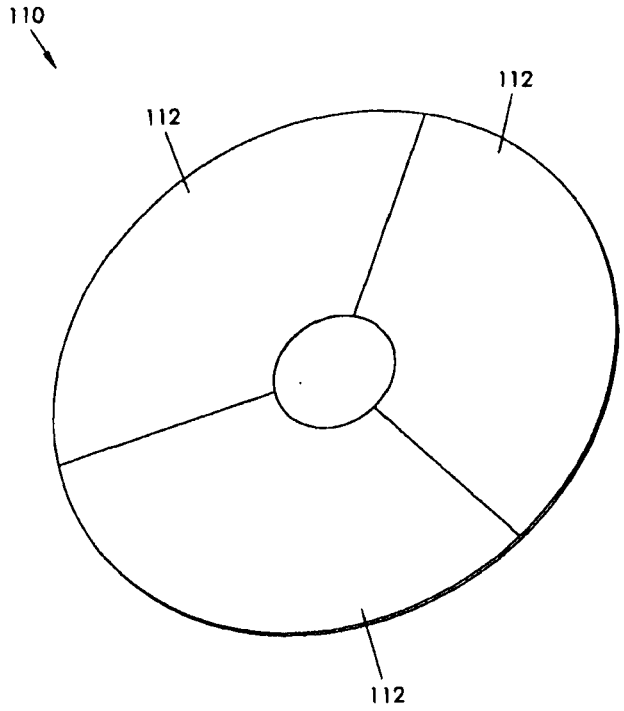
Figure 3:
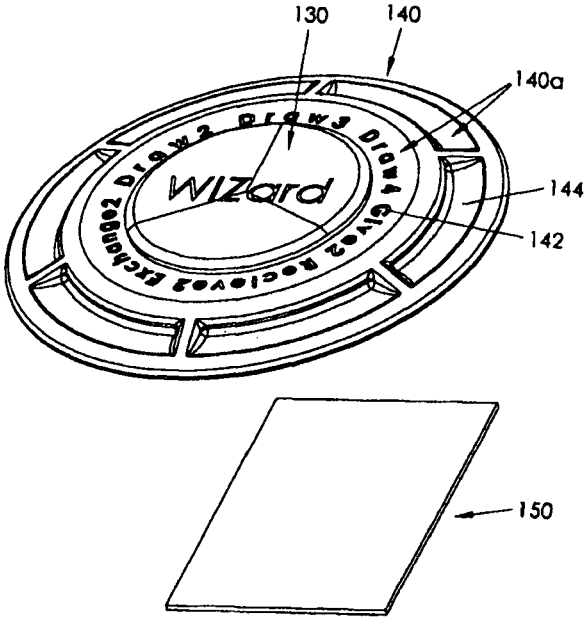
Figure 4:
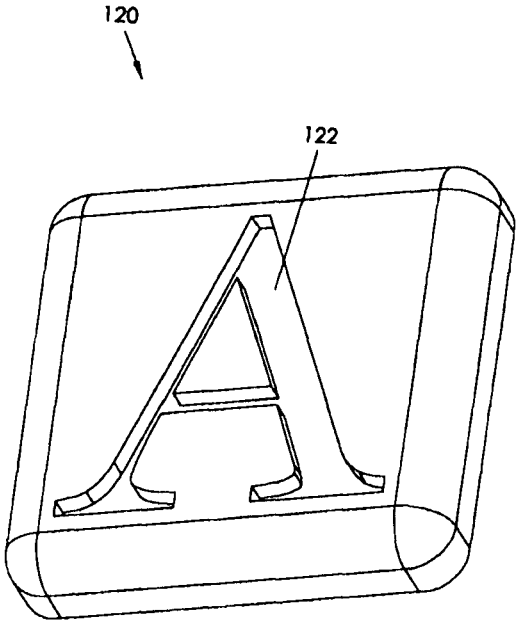
Figure 5:
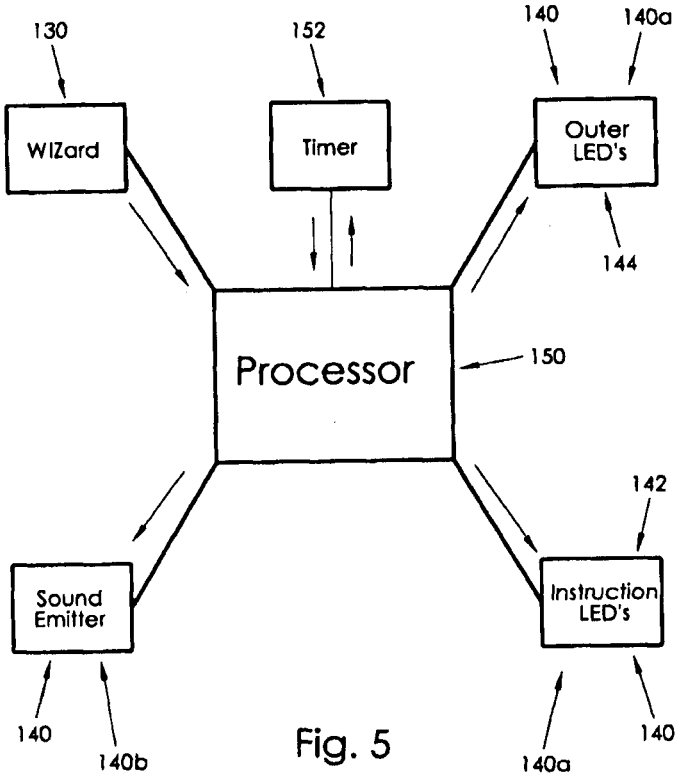
Figure 6:
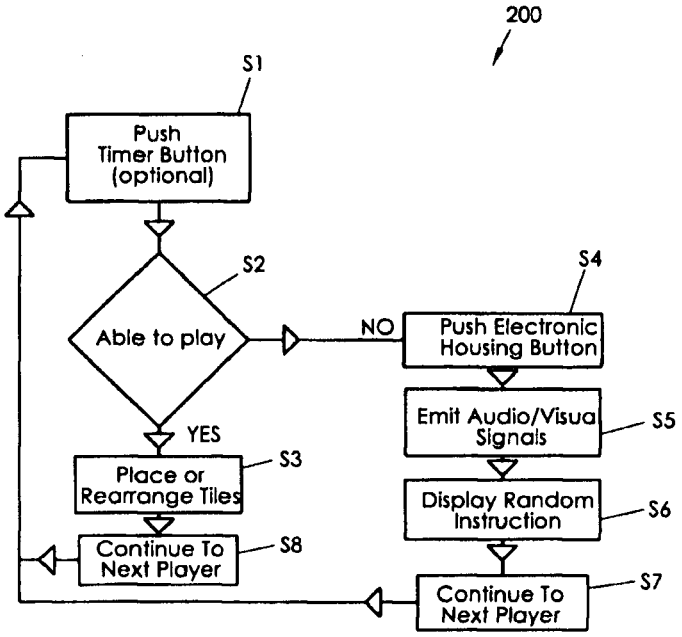

Some steps of the method 200 of playing a word game are shown in FIG. 6. Though not shown in FIG. 6, the entertainment system 100 as described above is provided for use by a plurality of players. Each player randomly selects a predetermined amount of game pieces 120 (e.g., from the container 170 through the container opening 172) and each player, in turn, may position the randomly selected game pieces 120 on a respective rack 160 in an upright configuration as described above. The randomly selected game pieces 120 will commonly include various indicia as described above, and the game pieces 120 may be positioned on the racks 160 so that the indicia of the game pieces 120 correspond to the indicia of the rack sections 164*a*; this may help the players view and keep track of the game pieces 120.

As shown at step S1 of FIG. 6, a first player may activate the input device 130 (e.g., by pressing the input device 130) to actuate the timer 152. The method then proceeds to step S2, where the player determines whether he can place at least a portion of the game pieces 120 (such as letter tiles) that he earlier selected on the playing surface 110. The game pieces 120 may only be placed in a field 112 having indicia corresponding to indicia on the game pieces 120, and the game pieces must be configured to spell a word. In other words, a game piece 120 having green indicia may only be played by placing it on a green field 112 with other green tiles arranged to spell a word. In some embodiments, each word must comprise at least a predetermined minimum amount of letters. If the player determines that he can place at least a portion of the game pieces 120 on the playing surface 110, the method proceeds to step S3. If the player determines that he cannot place at least a portion of the game pieces 120 on the playing surface 110, or if the timer 152 determines that the predetermined amount of time has elapsed and the processor 150 correspondingly actuates the display 140, the method proceeds to step S4.

At step S3, the player may place at least a portion of the game pieces 120 from his rack 160 onto a single field 112 of the playing surface 110 to spell a word as described above. After game pieces 120 are placed in a field 112 to spell a word, those game pieces 120 may be later used (i.e., in a consecutive turn by any player) to form different words in that field 112. For example, if game pieces 120 having red indicia are placed in a field 112 having red indicia to spell "plant", a player having game pieces 120 with red indicia and the letters "h, r, e, e" may subsequently remove the "t" from plant and spell "plan" and "three" in the field 112 having red indicia. If the player has a piece 120 with a user-choice indicator as described above, that piece 120 may be used with any indicia and may be used as any letter. However, no game piece 120 may be removed from a field 112 until a game is ended, and no game piece 120 may be placed in a field 112 or rearranged in a field 112 without being configured to spell a word. From step S3, the method proceeds to step S8. At step S8, the next player begins his turn, and the method returns to step S1.

At step S4, the player may actuate the input device 130 (e.g., by pressing the input device 130) to actuate the processor 150. The method then proceeds to step S5, where the processor 150 actuates the audible display 140*b* and/or the visual display 140*a* (e.g., the selectively illuminating aesthetic portions 144). The method then proceeds to step S6, where the processor 150 actuates the audible display 140*b* and/or the visual display 140*a* (e.g., a respective selectively illuminating predetermined instruction 142) to provide the player with a randomly selected instruction (e.g., draw three game pieces 120 from the container 170, give another player one game piece 120 from your rack 160, etc.), and the player follows the provided instruction. The method then proceeds to step S7. At step S7, the next player begins his turn, and the method returns to step S1.

A player who first places all of the game pieces from his rack 160 onto the playing surface 110 or into a rack 160 of another player in accordance with the rules may be determined the winner.

It is understood that while certain forms of this invention have been illustrated and described, it is not limited thereto except insofar as such limitations are included in the following claims and allowable functional equivalents thereof.

What is claimed is as follows:

1. An entertainment system, comprising:

a playing surface divided into a plurality of discrete fields, each respective field having distinct indicia;

a plurality of game pieces, each respective piece having indicia corresponding to said indicia of a respective field, each respective piece displaying an item selected from the group consisting of an alphabetic letter and a user-choice indicator;

an input device;

a display;

a processor in data communication with said input device and said display, said processor having programming for actuating said display to present an instruction randomly selected from a plurality of predetermined instructions upon actuation of said input device;

wherein each respective field is sized to receive a plurality of said pieces positioned in a juxtaposed configuration;

a plurality of racks, each respective rack having a lip and a back region to collectively hold a plurality of said pieces in an upright configuration;

wherein each respective back region includes a plurality of distinct sections, each respective section having indicia corresponding to said indicia of a respective field.

2. The system as in claim 1, wherein:

one of said playing surface and said plurality of game pieces is magnetic; and another of said playing surface and said plurality of game pieces is metallic.

3. The system as in claim 1, wherein:

said playing surface is magnetic; and each respective game piece has a recessed metallic central area.

4. The system as in claim 1, further comprising a container for housing at least a portion of said plurality of game pieces, said container having an opening for inserting and removing said game pieces.

5. The system as in claim 1, wherein said display is selected from the group consisting of an audible display and a visual display.

6. The system as in claim 1, wherein:

said processor includes a timer for determining a predetermined amount of elapsed time; and said processor includes programming for actuating said display upon said timer determining said predetermined amount of elapsed time.

7. The system as in claim 1, wherein:

said playing surface is circular and defines an imaginary center point;

said input device is situated at said imaginary center point;

said display includes a visual display circling said input device, said visual display presenting said plurality of predetermined instructions, each respective instruction being selectively illuminating.

8. The system as in claim 7, wherein:

said visual display has a plurality of selectively illuminating aesthetic portions;

said display includes an audible display;

said processor includes programming for selectively illuminating said aesthetic portions of said visual display; and said processor includes programming for selectively actuating said audible display.

9. The system as in claim 8, wherein:

said processor includes a timer for determining a predetermined amount of elapsed time; and said processor includes programming for actuating said display upon said timer determining said predetermined amount of elapsed time.

10. The system as in claim 9, wherein:

said playing surface is magnetic; and each respective game piece has a recessed metallic central area.

11. The system as in claim 10, further comprising a container for housing at least a portion of said plurality of game pieces, said container having an opening for inserting and removing said game pieces.

12. A method of a plurality of players playing a word game, said method comprising the steps of:

providing a playing surface divided into a plurality of discrete fields, each respective field having distinct indicia;

providing a plurality of game pieces, each respective game piece having indicia corresponding to said indicia of a respective field, each respective game piece displaying an item selected from the group consisting of an alphabetic letter and a user-choice indicator;

in turn each respective player randomly selecting a predetermined amount of game pieces from said plurality of game pieces;

in turn each respective player placing at least a portion of said randomly selected game pieces in a respective field having indicia corresponding to said indicia of said game pieces, each respective player configuring said placed game pieces to spell a word;

in turn each respective player placing at least another portion of said randomly selected game pieces in a respective field having indicia corresponding to said indicia of said game pieces, each respective player configuring said previously placed game pieces and said newly placed game pieces to spell a plurality of new words not previously appearing on said playing surface;

no game piece having indicia corresponding to said indicia of a respective field is placed in a respective field having indicia that does not correspond to said indicia of said game piece;

no game piece is removed from a respective field after being placed in said respective field;

no game piece is placed in a respective field without being configured to spell a word;

each respective word comprises a predetermined minimum amount of letters;

providing an input device; providing a display;

providing a processor in data communication with said input device and said display, said processor having programming for actuating said display to present an instruction randomly selected from a plurality of predetermined instructions upon actuation of said input device; and a respective player actuating said input device and following said randomly selected instruction when the respective player cannot place at least a portion of said randomly selected game pieces in a respective field having indicia corresponding to said indicia of said game pieces.

13. The method as in claim 12, further comprising the steps of:

providing a respective rack to each respective player, each respective rack having a lip and a back region to collectively hold a plurality of said pieces in an upright configuration, each respective back region including a plurality of distinct sections, each respective section having indicia corresponding to said indicia of a respective field; and each respective player positioning said randomly selected predetermined amount of game pieces on a respective rack in said upright configuration, wherein said game pieces are positioned on said racks with said game piece indicia corresponding to said rack section indicia.

14. The method as in claim 12, further comprising the step of providing a container for housing at least a portion of said plurality of game pieces, said container having an opening for inserting and removing said game pieces; and wherein said step of having each respective player randomly select a predetermined amount of game pieces includes having each respective player randomly select a predetermined amount of game pieces from said container through said container opening.

* * * * *

UNITED STATES PATENT AND TRADEMARK OFFICE

CERTIFICATE OF CORRECTION

PATENT NO. : 7,695,357 B2
APPLICATION NO. : 11/566752
DATED : April 13, 2010
INVENTOR(S) : Patricia L. Fleury and Martha K. Carter It is certified that error appears in the above-identified patent and that said Letters Patent is hereby corrected as shown below:

On the cover page, replace the informal drawing with the formal drawing of Fig. 1.

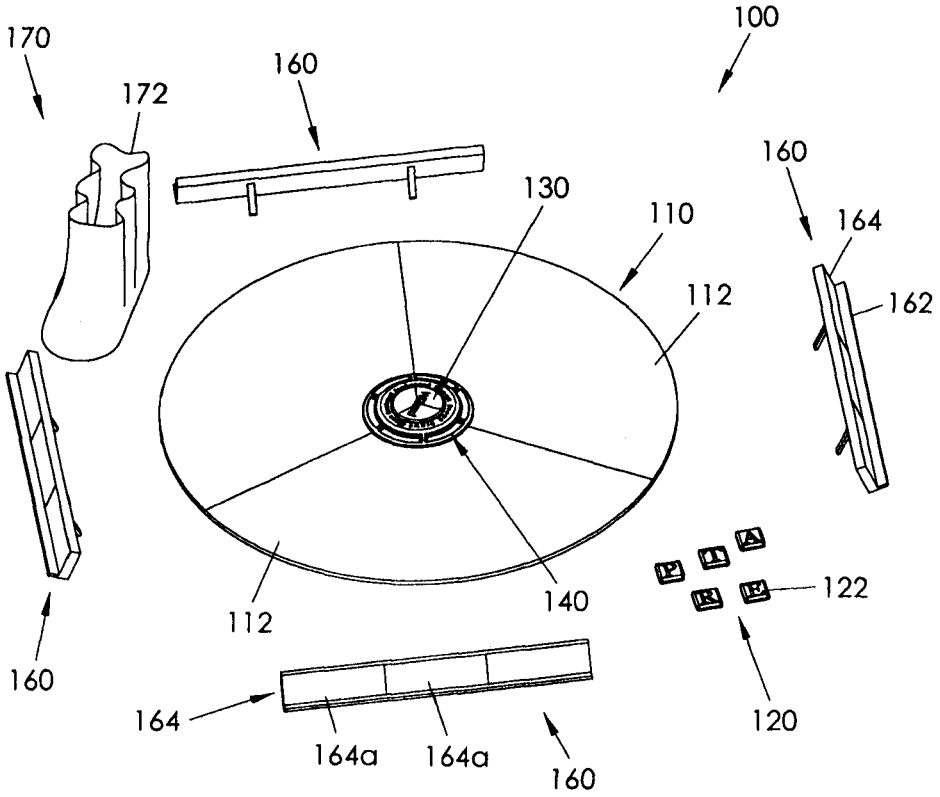

Signed and Sealed this

Twenty-first Day of September, 2010

David J. Kappos

David J. Kappos
*Director of the United States Patent and Trademark Office*

On drawing Sheet 1 of 6, replace the informal drawing of Fig. 1 with the formal drawing of Fig. 1.

On drawing Sheet 2 of 6, replace the informal drawing of Fig 2 with the formal drawing of Fig 2.

On drawing Sheet 3 of 6, replace the informal drawing of Fig 3 with the formal drawing of Fig 3.

On drawing Sheet 4 of 6, replace the informal drawing of Fig 4 with the formal drawing of Fig 4.

Figure 5:
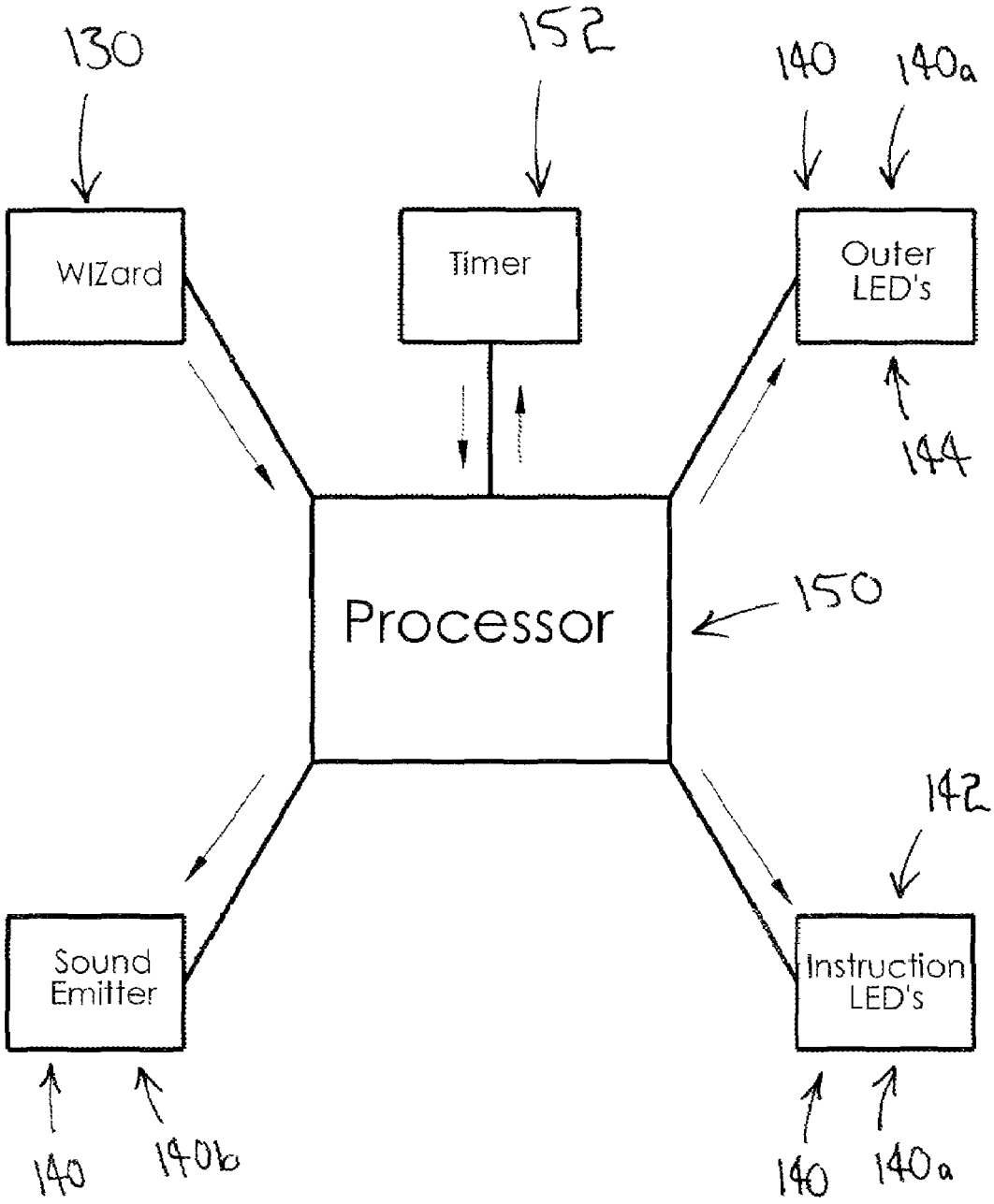
FIG. 5 is a block diagram of the electronic components of the present invention.

On drawing Sheet 5 of 6, replace the informal drawing of Fig 5 with the formal drawing of Fig 5.

On drawing Sheet 6 of 6, replace the informal drawing of Fig 6 with the formal drawing of Fig 6.